US005134870A

United States Patent [19]

Uyeda et al.

[11] Patent Number: 5,134,870

[45] Date of Patent: Aug. 4, 1992

[54] ELECTRO-MECHANICAL LOCK WITH ROTARY BOLT

[75] Inventors: Alan K. Uyeda, Pico Rivera; Klaus W. Gartner, Palos Verdes Estates; Peter J. Phillips, Long Beach; John Herrmann, Los Angeles, all of Calif.

[73] Assignee: La Gard, Inc., Torrance, Calif.

[21] Appl. No.: 533,893

[22] Filed: Jun. 6, 1990

[51] Int. Cl.[5] ..... E05B 47/00

[52] U.S. Cl. ..... 70/277; 70/303 A; 70/333 R; 70/279

[58] Field of Search ..... 70/277-279, 70/303 AR, 333 AR, 332

[56] References Cited

U.S. PATENT DOCUMENTS

| | | | |
|---|---|---|---|
| 2,053,901 | 9/1936 | Findlay | 70/303 A |
| 2,658,374 | 11/1953 | Behrens | 70/303 A X |
| 2,823,536 | 2/1958 | Watson . | |
| 3,702,070 | 11/1972 | Gartner . | |
| 3,758,734 | 9/1973 | Gartner . | |
| 4,106,316 | 8/1978 | Tippin | 70/303 A X |
| 4,148,092 | 4/1979 | Martin . | |
| 4,220,022 | 9/1980 | Willach | 70/278 |
| 4,268,076 | 5/1981 | Itoi | 70/279 X |
| 4,457,148 | 7/1984 | Johansson et al. . | |
| 4,665,727 | 5/1987 | Uyeda . | |
| 4,669,394 | 6/1987 | Fogleman et al. | 70/278 X |
| 4,685,709 | 8/1987 | Kambic | 70/279 X |
| 4,714,030 | 12/1987 | Cole . | |
| 4,745,784 | 5/1988 | Gartner . | |
| 4,831,851 | 5/1989 | Larson | 70/277 X |
| 4,887,445 | 12/1989 | Beatty | 70/278 |
| 4,895,008 | 1/1990 | Blake | 70/277 X |
| 4,899,562 | 2/1990 | Gartner et al. . | |
| 4,904,984 | 2/1990 | Gartner et al. . | |
| 4,967,577 | 11/1990 | Gartner et al. | 70/279 |

FOREIGN PATENT DOCUMENTS

| | | | |
|---|---|---|---|
| 407305 | 9/1944 | Italy | 70/303 R |

*Primary Examiner*—Rennee S. Luebke
*Assistant Examiner*—Suzanne L. Dino
*Attorney, Agent, or Firm*—Poms, Smith, Lande & Rose

[57] ABSTRACT

An electronic lock for a safe door is provided with a digital keypad entry device, a mechanical bolt works and associated handle for retracting the door bolts, and a spring biased rotary bolt which engages and precludes operation of the bolt works, such that upon entry of the predetermined code into the entry device, an electric signal causes a solenoid to energize and retract its armature from a blocking position relative the rotary bolt, further enabling the rotary bolt to rotate against its bias in response to mechanical maniupulation of the handle by the user to retract the door bolts. Unauthorized operation of the safe handle causes the rotary bolt to be locked into a fixed position, preventing entry into the safe.

11 Claims, 4 Drawing Sheets

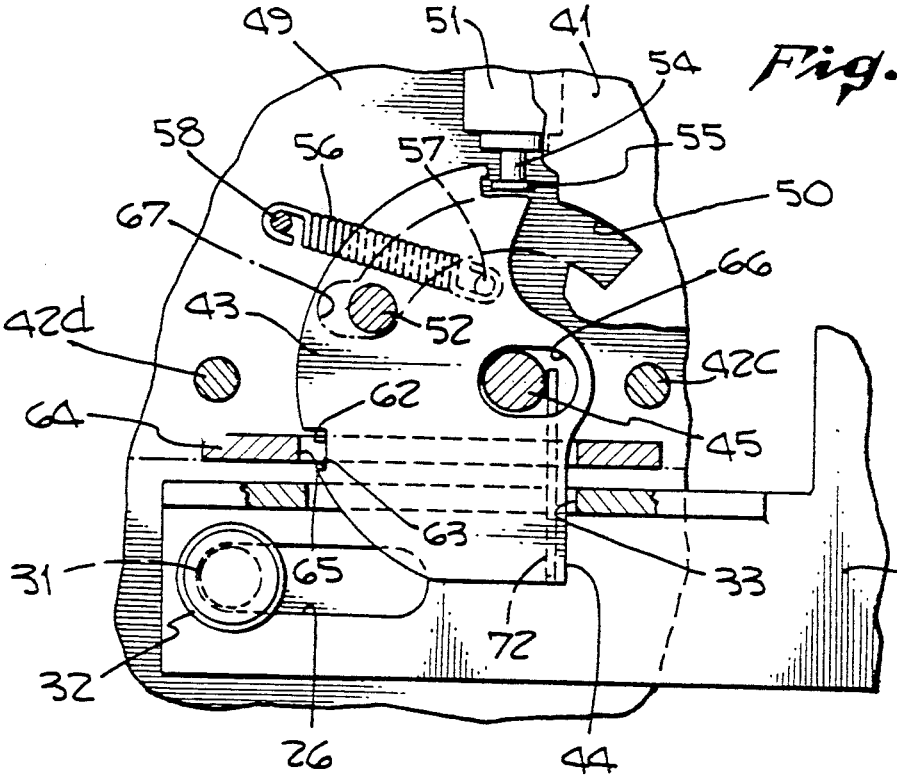
Fig. 8.
Fig. 9.
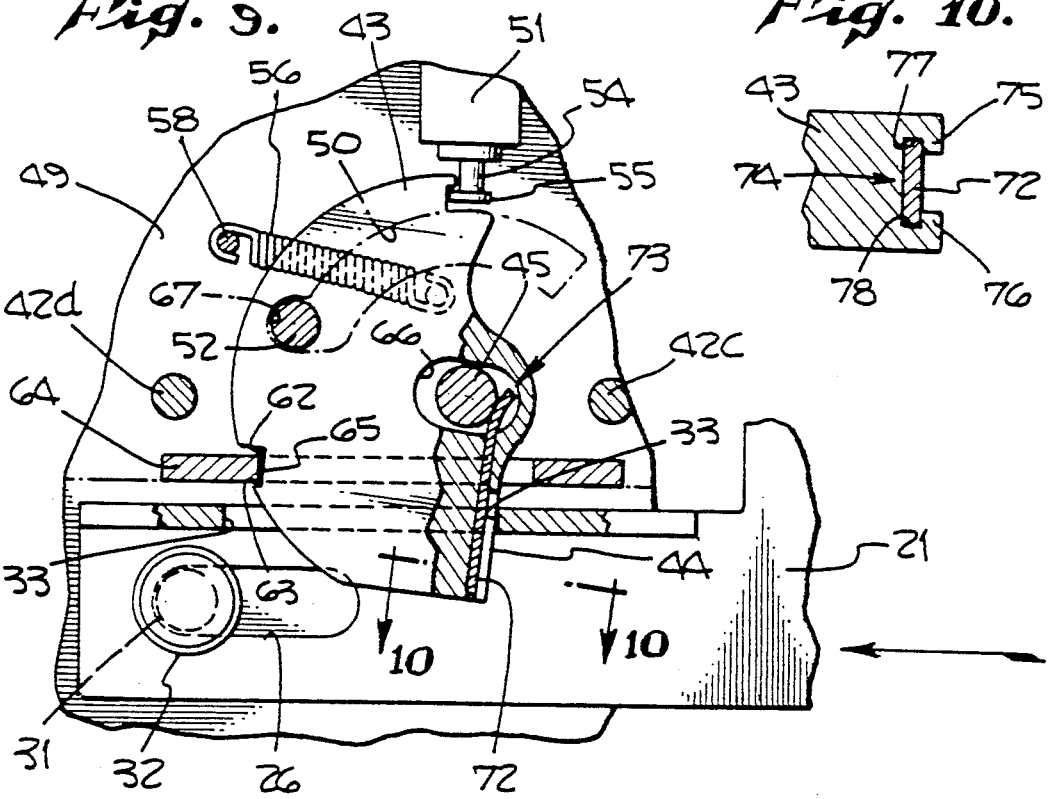
Fig. 10.

ELECTRO-MECHANICAL LOCK WITH ROTARY BOLT

INTRODUCTION

Generally stated, the present invention relates to electrically operated locks for safe doors and the like, and more particularly to an electro-mechanical lock with a rotary bolt for use with safe doors having manually operated bolt works.

BACKGROUND OF THE INVENTION

Doors of safes, vaults, strong rooms, and like security closures (hereinafter collectively referred to as safes) are provided with at least one and preferably a plurality of bolts that are reciprocated from a non-locking position to an extended locking position. When more than one bolt is provided, a bolt works connects the bolts so that they may be simultaneously moved when a single handle is operated. A locking device is also provided to secure the bolts in their extended locking position.

An electronic locking device for such a safe is disclosed in U.S. Pat. No. 4,665,727. In this prior exemplary electronic lock mechanism, an electronically articulated linkage is provided which enables manipulation of the bolt works after entry of a predetermined combination code. However, a problem encountered with articulable linkage mechanisms is that they are susceptible to unauthorized movement due to pounding, jostling or otherwise manipulating the door handle.

A rotary bolt mechanism is much less susceptible to such unauthorized lateral movement, and therefore provides greater security to operators and users of safes. A rotary bolt mechanism for a safe is disclosed in U.S. Pat. No. 4,493,199. In this prior exemplary bolt mechanism, a rotatably mounted cam member is provided which drives the door bolts between locking and unlocking positions after manipulation of a mechanical dial lock mechanism. It is anticipated that users of safes would prefer the ease, convenience and reliability of an electronic lock with the tamper proof characteristics of a rotary bolt.

SUMMARY OF THE INVENTION

It would be desirable to be able to modify a standard safe door bolt mechanism with an electronic lock which would give increased security and convenience to such a door. It would also be desirable to be able to continue to use the preexisting bolt works and safe door opening handle provided on such safe doors.

It is therefore a primary object of the present invention to provide an electronic lock mechanism for a conventional safe door wherein the lock mechanism is assembled to such a safe door in place of the manipulative portions of the existing mechanical lock mechanism. It is also an object of the present invention to provide such an electronic lock wherein an electronic digital keypad entry device may be employed for entry of the combination. It is still further object of the present invention to provide a lock as in the foregoing objects wherein the movement of the safe door handle is restricted until after the code has been entered, the handle then being freed to be manipulated by the user to throw the safe bolt between the safe door locked protracted and door unlocked retracted positions. It is still further object of the present invention to provide a lock as in the foregoing objects wherein movement of the door bolts is precluded by the use of a rotary bolt. It is yet another object of the present invention to provide a lock as in the foregoing objects which is impervious to unauthorized manipulation, such as pounding or jostling.

Generally stated, the present invention includes the provision of an electronic code entry device, a safe door bolt manipulation means which moves the safe door bolts between protracted and retracted positions in response to rotation of a standard safe door handle, and a locking means for normally restricting operation of the bolt manipulation means until the predetermined electronic code has been entered and a code responsive signal generated. Additionally, an entry preclusion means is provided which precludes unauthorized operation of the locking means.

More specifically, the locking means of the present lock includes a spring biased rotary bolt provided with a limit stop and a cam surface, wherein the cam surface engages and restricts operation of the bolt manipulation means, and a solenoid armature post normally biased to a position where it engages the limit stop restricting rotation of the rotary cam bolt until after entry of the predetermined code, at which time the post retracts allowing rotation of the rotary bolt against its bias. More specifically, the limit stop has an over-hanging retainer lip and the post has a flange on the end whereby the post flange underlies the limit stop retainer lip to prevent unauthorized lock defeating manipulation of the post through vibration, pounding or other attempted unauthorized manipulation of the lock.

A more complete understanding of the electro-mechanical lock of the present invention will be afforded to those skilled in the art, as well as a realization of additional advantages and objects thereof, by a consideration of the following detailed description of a preferred exemplary embodiment thereof. Reference will be made to the appended sheets of drawings which will be first described briefly.

DESCRIPTION OF THE DRAWINGS

FIG. 8 is an enlarged detail view, as in FIG. 6, showing the rotary cam bolt and the exemplary unauthorized entry preclusion means;

FIG. 9 is a view as in FIG. 8 showing the preclusion means in the secured position; and FIG. 10 is a sectional view through the rotary cam bolt, as revealed by the section 10—10 taken in FIG. 9.

DETAILED DESCRIPTION OF A PREFERRED EXEMPLARY EMBODIMENT

Figure 1:
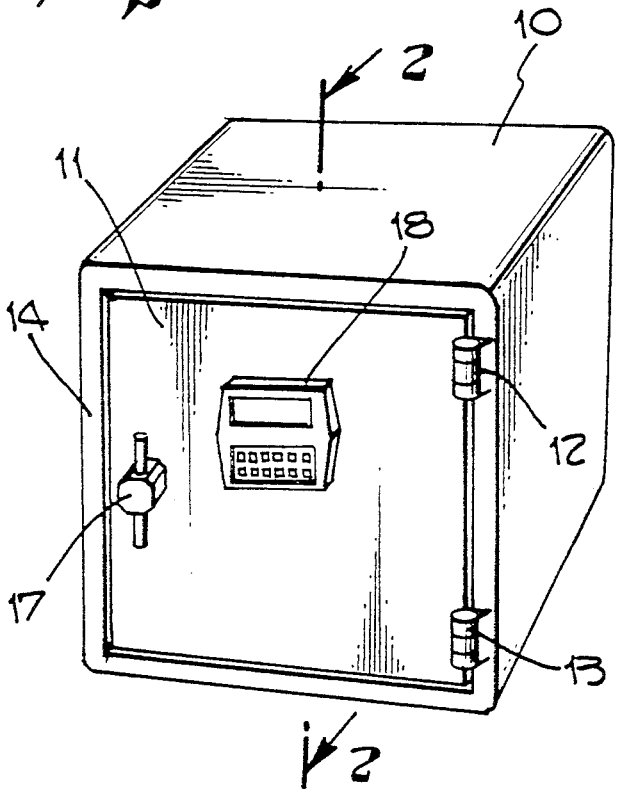
FIG. 1 is a perspective view of an exemplary safe door installation of a preferred exemplary embodiment of the electro-mechanical lock of the present invention.

Referring to FIG. 1, a preferred exemplary embodiment of an electro-mechanical lock for a safe door in accordance with the present invention is illustrated in association with a safe 10 having an otherwise standard door 11 attached by hinges 12 and 13, and having handle 17 to operate the bolt works mechanism, as hereinafter described. An electronic code entry device 18 having an internal circuit board is mounted on the front of the door 11 and is used for entering the combination code and generating an electrical signal, as will also be described hereinafter.

Figure 2:
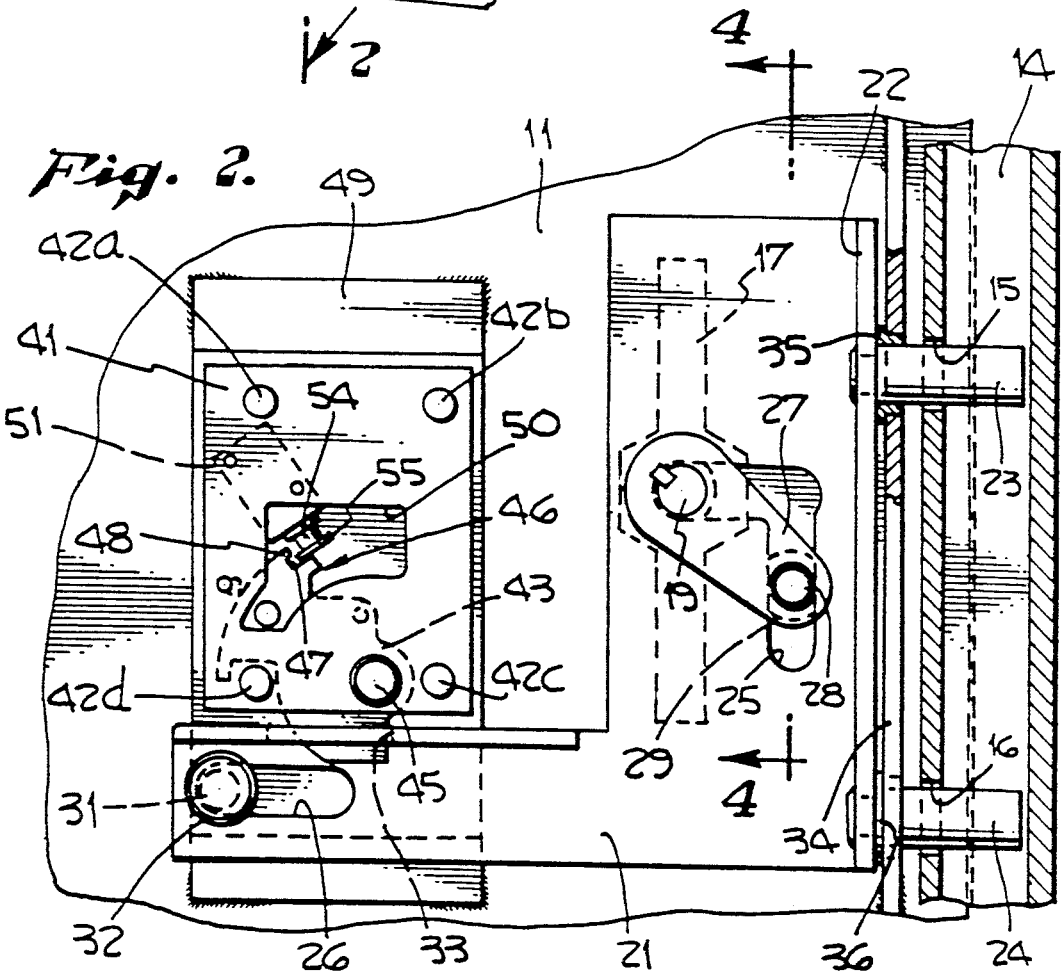
FIG. 2 is a partial view of the interior of the exemplary safe door showing the electro-mechanical lock mechanism in the bolt protracted position, as revealed by the section 2—2 taken in FIG. 1.
Figure 4:
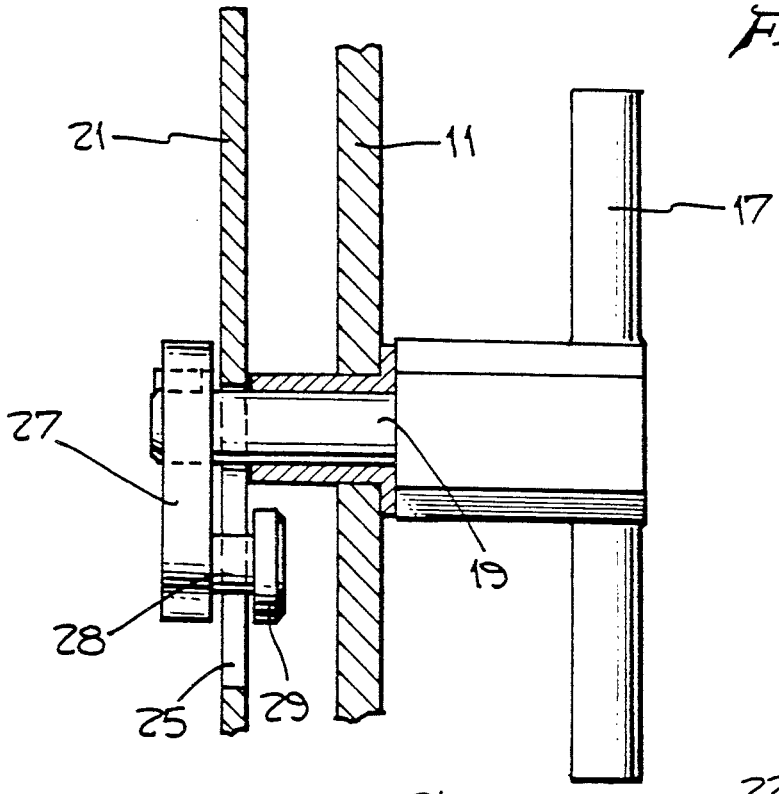
FIG. 4 is a sectional view of the exemplary bolt manipulation means, as revealed by the section 4—4 taken in FIG. 2.

As seen in FIG. 2, the interior of safe door 11 has an edge flange 34 and a locking means mounting plate 49, to which is mounted the exemplary locking means, as will be hereinafter described. Mechanically attached to the interior of door 11 is a laterally movable retraction plate 21. The retraction plate 21 is generally L-shaped, and has a right angled mounting flange 22. The exemplary safe door two bolts 23 and 24 which are attached to mounting flange 22 and pass through linear bearings 35 and 36, integral to edge flange 34. Door bolts 23 and 24 are relatively positioned to engage bolt receptacles 15 and 16 in safe door jamb 14. Handle 17 is assembled to shaft 19, which penetrates the door 11 and attaches to retraction arm 27 such that operation of handle 17 in a rotary manner causes direct rotation of retraction arm 27.

Retraction plate 21 has a pair of guide paths 25 and 26 cut into its surface, in which retraction pins 28 and 31 travel, and a cam lock aperture 33, as will be hereinafter described. Upper retraction pin 28 is fixed to retraction arm 27, and lower retraction pin 31 is fixed to the interior of safe door 11, such that rotation of door handle 17 causes upper retraction pin 28 to move through an arc within guide path 25 and exert a lateral force on retraction plate 21, further causing lateral motion of retraction plate 21 parallel to door 11 along guide paths 25 and 26. To prevent skewing of retraction plate 21 during its lateral motion, guide wheels 29 and 32 are provided. Guide wheel 29 mounts on the end of upper retraction pin 28, and guide wheel 32 mounts on the end of lower retraction pin 31. In the preferred embodiment, a clockwise rotation of door handle 17, as viewed from the front of the safe 10 per FIG. 1, causes lateral movement of retraction plate 21 in a protracting direction further causing bolts 23 and 24 to protract relative door 11 through linear bearings 35 and 36, and into receptacles 15 and 16, into the door locked position. Likewise, a counter-clockwise rotation of door handle 17 results in retraction of bolts 23 and 24 from receptacles 15 and 16, into the door unlocked position. However, lateral movement of retraction plate 21 as described hereinbefore is normally prevented by the use of a locking means.

Figure 7:
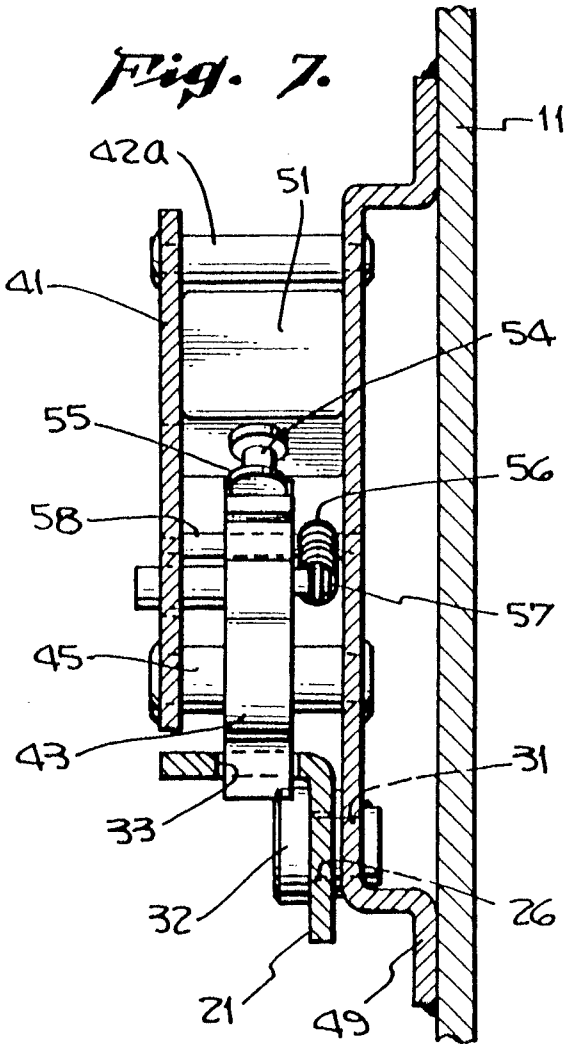
FIG. 7 is a sectional view through the locking means, as revealed by the section 7—7 taken in FIG. 6.

Referring now to FIG. 7, the exemplary locking means is mechanically attached to mounting plate 49, and includes the provision of a rotary bolt 43, an axle shaft 45 and an electrically operable solenoid 51. Rotary bolt 43 is generally semicircular in shape, and having a center bore 38 a cam surface 44 and a limit stop, indicated generally at 46. Axle shaft 45 is rigidly attached to mounting plate 49, and rotatably attaches to bore 38 of rotary bolt 43 such that rotary bolt rotates through a plane parallel to door 11. Solenoid 51 is secured to mounting plate 49 by bolts 53*a* and 53*b*. Cover plate 41 is also provided, which attaches to mounting plate 49 by means of four spacer pins $42_a$, $42_b$, $42_c$, $42_d$, and which blocks access to the locking means. Arcuate slot 50 is placed in cover plate 41, which exposes a portion of rotary bolt 43 and solenoid 51, as best shown in FIG. 2. Limit pin 52 is attached to rotary bolt 43, and travels in arcuate slot 50 as the rotary bolt rotates and which limits the arcuate travel of rotary bolt in both directions.

Figure 6:
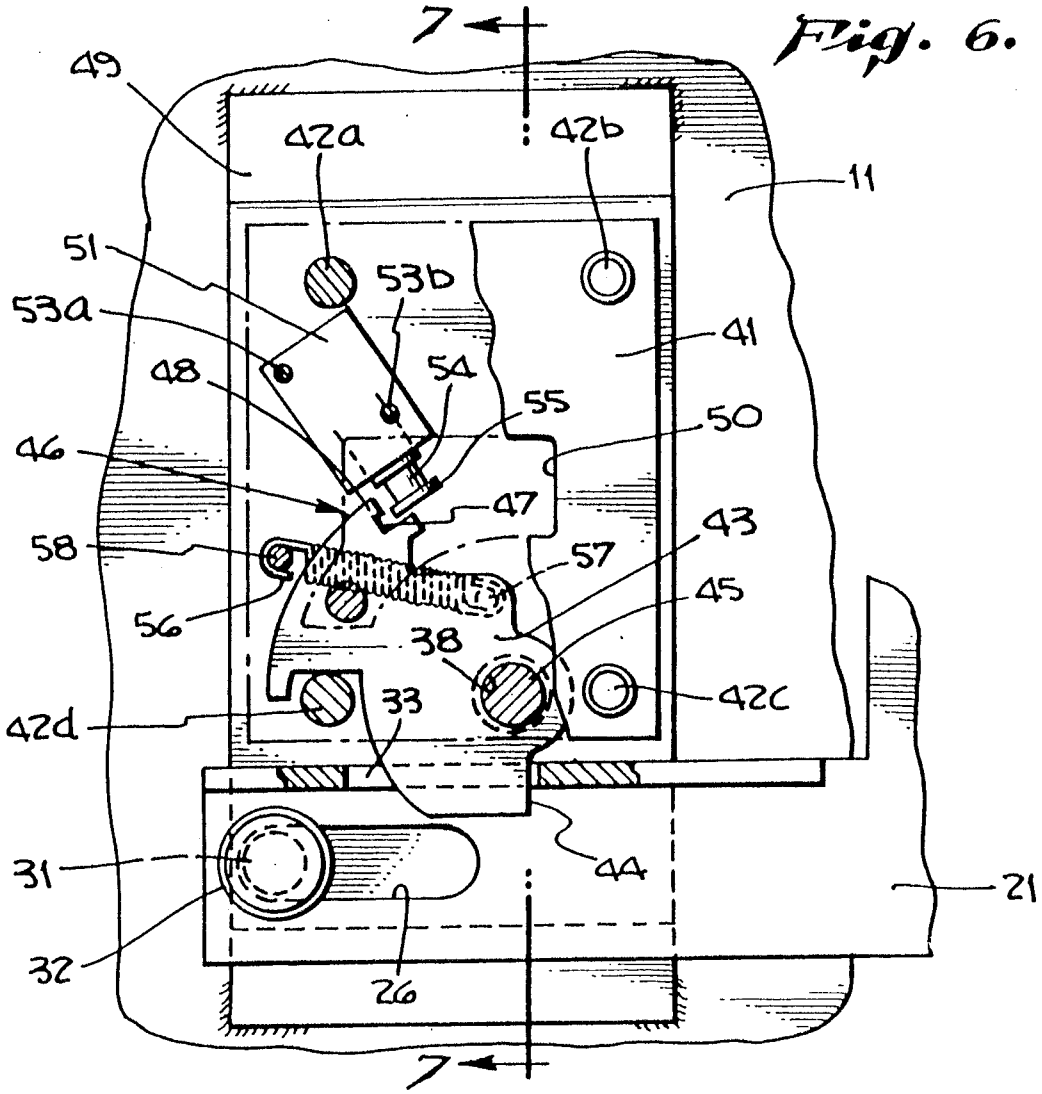
FIG. 6 is an enlarged detail view, similar to FIG. 2, showing the rotary cam bolt in the biased position.

The exemplary rotary bolt 43 normally engages lock aperture 33 on retraction plate 21, as illustrated in FIGS. 2, 6 and 7, such that lateral movement of retraction plate 21 is impeded. Rotary bolt 43 is normally biased into the first locking position relative lock aperture 33 by use of biasing spring 56, which attaches to rotary bolt at a first spring retaining pin 57 and to mounting plate 49 at a second spring retaining pin 58.

In the preferred exemplary embodiment, cam surface 44 of rotary bolt 43 contacts the trailing edge of lock aperture 33 such that lateral movement of retraction plate 21 as caused by manipulation of handle 17 further causes rotary bolt 43 to rotate clockwise, as viewed from the interior of safe 10 per FIG. 2, against its spring bias to a second unlocked position in which rotary bolt 43 has fully moved out of the locking position relative retraction plate 21. During prolonged periods in which the door 11 remains open, the rotary bolt 43 will remain in the second position against its bias due to contact between retraction plate 21 and cam surface 44, until the user returns the door handle 17 to the door locked position, protracting bolts 23 and 24, upon which cam surface 44 will re-engage aperture 33 and rotary bolt 43 rotates back to its normally biased position.

Figure 5:
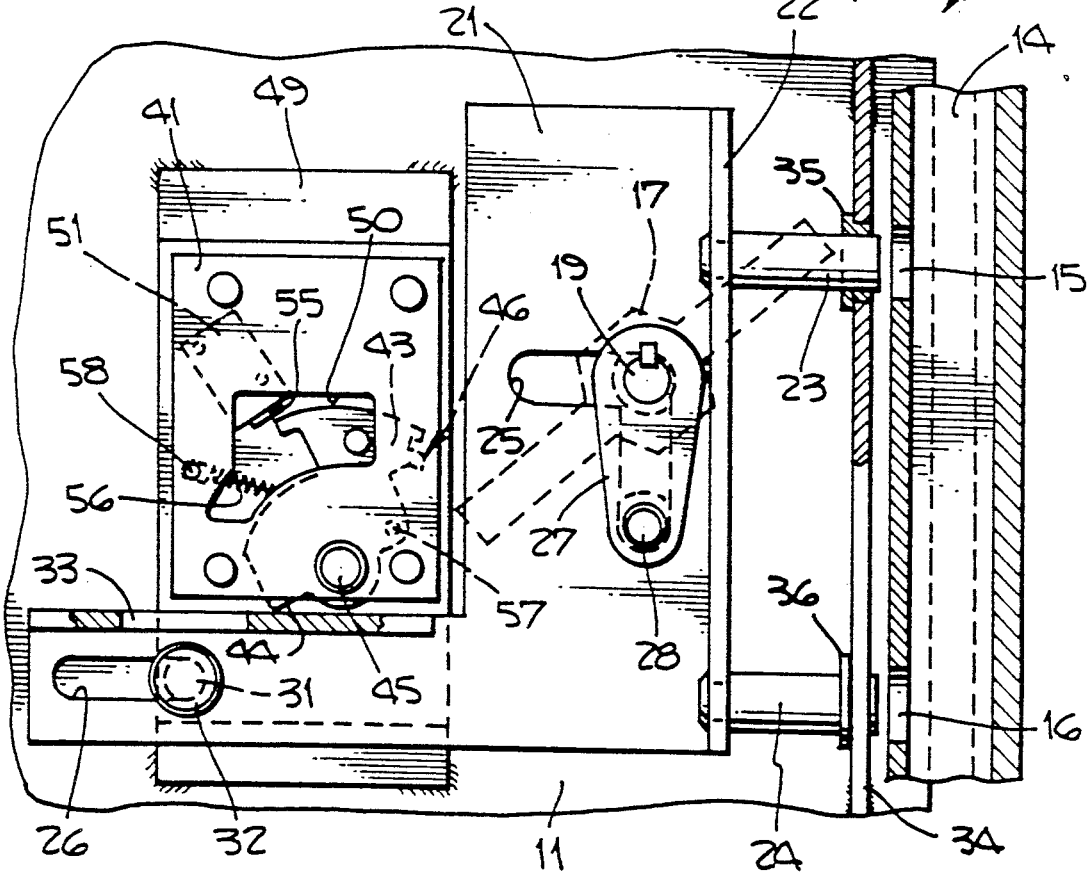
FIG. 5 is a view as in FIG. 2 showing the electro-mechanical lock mechanism in the bolt retracted position.

The exemplary locking means also includes the provision of post 54, and a limit stop, indicated generally at 46 as shown in FIGS. 2, 5 and 6. Post 54 comprises a portion of the armature of an electrically operable solenoid 51 also fixed to mounting plate 49. The exemplary limit stop comprises limit stop surface 47 and an overhanging retainer lip 48, both integral to rotary cam bolt 43. Post 54 is positioned as seen in FIGS. 2 and 6, such that post retainer flange 55 normally engages the exemplary limit stop, thus preventing rotation of rotary bolt 43, and thus further preventing lateral movement of retraction plate 21. The provision of the retainer lip 48 is important to prevent unauthorized rotation of rotary bolt 43 as might otherwise occur if the post 54 could be urged inwardly of solenoid 51 against the outward bias of an internal spring provided, through vibration, tapping or other unauthorized manipulation of the lock mechanism.

Figure 3:
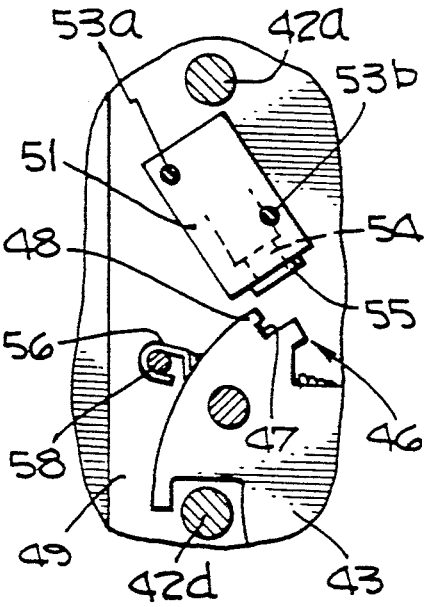
FIG. 3 is a partial view of the exemplary locking means with the solenoid in the armature retracted position.

As is particularly contemplated within the present invention, the manual entry of a coded sequence into combination code entry device 18 causes the generation of an electrical signal, such as a voltage, as known in the art. The electrical signal is transferred by known electrical means to solenoid 51, which energizes and retracts post 54 inwardly against its internal spring bias, as shown in FIG. 3, disengaging the exemplary locking means. The user is then free to manipulate door handle 17, causing movement of retraction plate 21, which further causes rotary bolt 43 to rotate against its spring bias unimpeded by post 54, bringing cam surface 44 out of contact with aperture 33 and eventually allowing the full retraction of bolts 23 and 24 to the door unlocked position as shown in FIG. 5.

Also contemplated within the present invention is the use of an exemplary entry preclusion means to prevent unauthorized entry of the safe. As illustrated in FIGS. 8 and 9, the entry preclusion means includes the provision of a safety notch 62, a safety key 64, an elongated bore 66 and a leaf spring 72. Safety notch 62 is integral to the periphery of rotary bolt 43, and is positioned relative safety key 64, which is fixably attached to mounting plate 49 to lockingly engage the key 64 on forceable manipulation of handle 17 as subsequently described. Elongated bore 66 is provided in the center of rotary bolt 43, and which mates with axle shaft 45. Elongated bore 66 is elliptical in shape, with its major axis running parallel to the direction of lateral travel of the retraction plate 21, such that rotary bolt 43 can be laterally as well as rotatably manipulated. Additionally, arcuate slot 50 is provided with a semi-circular extension 67, as shown in FIG. 8, also parallel in direction to the major axis of elongated bore 66.

Rotary bolt 43 is also exemplarily provided with a slot, indicated generally at 74 as shown in FIG. 10. Slot 74 is recessed within rotary bolt 43 and positioned adjacent to cam surface 44, and is sized to accept leaf spring 72. Trailing portions 75 and 76 and lateral surfaces 77 and 78 rigidly hold leaf spring 72 within slot 74, and trailing portions 75 and 76 also provide the cam surface 44. Leaf spring 72 protrudes into the elongated bore 66 where it tangentially contacts axle shaft 45. With leaf spring 72 in its normally biased position, rotary bolt 43 is in the normally operable position, as previously described hereinabove.

Unauthorized operation of door handle 17 causes retraction plate 21 to apply a lateral force on cam surface 33. Rotary bolt 43 is impeded from rotating due to contact with post 54, therefore, the lateral force causes a lateral shift of the rotary bolt. Axle shaft 45 moves within elongated bore 66, deflecting leaf spring 72, shown generally at 73 in FIG. 9. Safety notch 62 maneuvers into engagement with safety key 64, and limit pin 52 enters semicircular slot extension 67 of arcuate slot 50. With rotary bolt 43 laterally shifted such that safety key 64 has fully engaged safety notch 62, the rotary bolt is secured from any further rotation, precluding additional manipulation of retraction plate 21 by the unauthorized user. As can be seen in FIG. 9, continued unauthorized force causes lower edge 63 of safety notch 62 to press against surface 65 of safety key 64, keeping safe 10 effectively locked. Once the unauthorized operation has ceased, the rotary bolt 43 returns to its normally operable position, as shown in FIG. 8, wherein normal operation as described hereinbefore can take place.

Having thus described a preferred exemplary embodiment of an electro-mechanical safe door lock in accordance with the present invention, it should now be apparent to those skilled in the art that the aforestated objects and advantages for the within lock have been achieved. It should also be appreciated by those skilled in the art that various modifications, adaptations and alternative embodiments thereof may be made within the scope and spirit of the present invention which is defined by the following claims.

We claim:

1. An electro-mechanical lock for a safe door having a code entry door bolt mechanism, comprising:

a door handle, a plurality of safe door bolts and means for manipulating said bolts between protracted and retracted positions relative said door in response to rotational operation of said handle;

a locking means for normally restricting operation of said bolt manipulation means, said locking means including a spring biased rotary bolt which is rotatable through an arc between a normally biased position impeding operation of said bolt manipulation means and a second position allowing unimpeded operation of said bolt manipulation means, said rotary bolt independently impeding said bolt manipulation means when in said normally biased position; and an electrically operated means for producing a code responsible signal to disengage said locking means to allow rotation of said bolt to said second position and thereby enable manipulation of said door bolts.

2. The electro-mechanical lock of claim 1 wherein:

said rotary bolt has a cam surface and said bolt manipulation means comprises a movable retraction plate integral to said bolts and having a plurality of guide paths for guiding manipulation of said retraction plate between bolt protracted and retracted positions; and a lock aperture integral to said retraction plate for being engaged by said rotary bolt cam surface.

3. The electro-mechanical lock of claim 2 wherein:

said locking means further comprises a rotation limit stop on the periphery of said rotary bolt and a post normally positioned to engage said limit stop and block further rotation of said rotary bolt.

4. The electro-mechanical lock of claim 3 wherein:

said rotary bolt has an over-hanging retainer lip associated with said limit stop; and said post has a retainer flange whereby when said post engages said limit stop, said post flange is retained by said retainer lip, preventing unauthorized rotation of said rotary bolt.

5. The electro-mechanical lock of claim 4 wherein:

said electrically operated means comprises an electronic combination entry device for manual entry of said coded sequence and a circuit board associated with said entry device for generating said code responsive signal; and a solenoid having a body and an armature portion normally biased outwardly of said body, said armature providing said post.

6. The electro-mechanical lock of claim 5 wherein:

said rotary bolt has a perpendicularly mounted limit pin; and said locking means further comprises an arcuate slot having a first end and a second end, said slot being disposed relative to said rotary bolt such that said limit pin travels within said slot in response to rotation of said rotary bolt;

whereby when said rotary bolt is at said normally biased position, said limit pin engages said first end of said slot, and when said rotary bolt is at said second position, said limit pin engages said second end of said slot, limiting arcuate travel of said rotary bolt.

7. An electro-mechanical lock for a safe door having a code entry door bolt mechanism, comprising:

a door handle, a plurality of safe door bolts and means for manipulating said bolts between protracted and retracted positions relative said door in response to rotational operation of said handle;

a locking means for normally restricting operation of said bolt manipulation means, said locking means including a spring biased rotary locking bolt which is rotatable through an arc between a normally biased position impeding operation of said bolt manipulation means and a second position allowing unimpeded operation of said bolt manipulation means;

an electrically operated means for producing a code responsive signal to disengage said locking means to allow rotation of said bolt to said second position and thereby enable manipulation of said door bolts; and an entry preclusion means for restricting rotation of said rotary bolt independently of the operation of said locking means in response to unauthorized operation of said door handle.

8. An electro-mechanical lock for a safe door having a code entry door bolt mechanism, comprising:

a door handle, a plurality of safe door bolts, a movable retraction plate integral to said bolts and means for manipulating said bolts via said retraction plate between protracted and retracted positions relative said door in response to rotational operation of said handle;

a locking means for normally restricting operation of said bolt manipulation means, said locking means including a spring biased rotary locking bolt which has a cam surface and is rotatable through an arc between a normally biased position impeding operation of said bolt manipulation means and a second position allowing unimpeded operation of said bolt manipulation means;

an electrically operated means for producing a code responsive signal to disengage said locking means to allow rotation of said bolt to said second position and thereby enable manipulation of said door bolts; and an entry preclusion means for restricting rotation of said rotary bolt in response to unauthorized operation of said door handle, wherein:

said preclusion means comprises a safety notch, a safety key, a leaf spring and an elongated bore, said safety notch being integral to the periphery of said rotary bolt and disposed relative to be engaged by said safety key, said elongated bore extending through the center of said rotary bolt and enabling said rotary bolt to shift between a normally operable position and a secured position, and said leaf spring normally biasing said rotary bolt into said operable position;

whereby when unauthorized rotational force is applied to said door handle, said retraction plate applies lateral force against said cam surface of said rotary bolt, further urging said rotary bolt to laterally shift against its bias into said secured position wherein said safety key engages said safety notch, further precluding rotation of said rotary bolt out of said secured position impeding operation of said bolt manipulation means.

9. The electro-mechanical lock of claim 8 wherein:

said rotary bolt has a recessed slot and said leaf spring engages said recessed slot such that a portion of said leaf spring protrudes into said elongated bore.

10. An electro-mechanical lock for a safe door having a code entry door bolt mechanism, comprising:

one or more door bolts and means for manipulating said bolts between protracted and retracted positions relative said door;

a locking means for normally restricting operation of said bolt manipulation means, said locking means including a spring biased rotary bolt which is rotatable through an arc between a normally biased position impeding operation of said bolt manipulation means and a second position allowing unimpeded operation of said bolt manipulation means;

an electrically operated means for producing a code responsive signal to disengage said locking means to allow rotation of said bolt to said second position and thereby enable manipulation of said door bolts; and an entry preclusion means for restricting rotation of said rotary bolt in response to unauthorized operation of said means for manipulating said bolts, wherein:

said entry preclusion means comprises a safety notch integral to the periphery of said rotary bolt and said rotary bolt is mounted for both rotational and lateral movement enabling said rotary bolt to shift between a normally operable position wherein it can rotate to said second position and a secured position where it cannot rotate to said second position by virtue of interaction of said notch and a safety key provided in said lock, whereby when unauthorized force is applied to said means for manipulating said bolts, said means urges said rotary bolt to laterally shift into said secured position wherein said safety key engages said safety notch, further precluding rotation of said rotary bolt out of said secured position impeding operation of said bolt manipulation means.

11. An electro-mechanical lock for a safe door having a code entry door bolt mechanism, comprising:

one or more door bolts and means for manipulating said bolts between protracted and retracted positions relative said door;

a locking means for normally restricting operation of said bolt manipulation means, said locking means including a spring biased rotary bolt which is rotatable through an arc between a normally biased position impeding operation of said bolt manipulation means and a second position allowing unimpeded operation of said bolt manipulation means, said rotary bolt independently impeding said bolt manipulation means when in said normally biased position;

an electrically operated means for producing a code responsive signal to disengage said locking means to allow rotation of said bolt to said second position and thereby enable manipulation of said door bolts; and an entry preclusion means for restricting rotation of said rotary bolt in response to unauthorized operation of said means for manipulating said bolts, wherein said entry preclusion means including mounting means for mounting said rotary bolt for a shifting laterally to a non-rotatable secured position when unauthorized rotational force is applied to said means for manipulating said bolts.

* * * * *